US006135119A

United States Patent [19]

Okumoto et al.

[11] Patent Number: 6,135,119

[45] Date of Patent: Oct. 24, 2000

[54] DEVICE FOR COMPRESSIVE MOLDING STREAM OF FILLER FOR TOBACCO ROD

[75] Inventors: Yutaka Okumoto; Hisao Suzuki, both of Tokyo, Japan

[73] Assignee: Japan Tobacco Inc., Tokyo, Japan

[21] Appl. No.: 09/137,103

[22] Filed: Aug. 20, 1998

[30] Foreign Application Priority Data

Aug. 20, 1997 [JP] Japan ..... 9-223564

[51] Int. Cl.[7] ..... A24C 5/18

[52] U.S. Cl. ..... 131/84.2; 131/84.3; 131/84.1

[58] Field of Search ..... 131/60, 66.1, 66.2, 131/75, 77, 84.1, 84.2, 84.3, 87

[56] References Cited

U.S. PATENT DOCUMENTS 2,163,414 6/1939 Stephano .
2,164,423 7/1939 Podmore .
2,209,139 7/1940 Ruau .
2,308,323 1/1943 Williams .
2,617,426 11/1952 Patterson .
2,853,079 9/1958 Dupke .
5,810,016 9/1998 Okumoto ..... 131/84.1

*Primary Examiner*—Stanley S. Silverman
*Assistant Examiner*—Robert McBride
*Attorney, Agent, or Firm*—Birch, Stewart, Kolasch & Birch, LLP

[57] ABSTRACT

In a cigarette manufacturing machine, a device for compressive molding a stream of filler comprises a forming mold having a tongue and a shoe being integrally formed with each other, and a forming surface formed at a lower surface of the tongue, and a compression molding passage for the stream is defined between the forming surface and paper. The forming surface of the tongue has a movable surface formed of a part of an endless belt, and the movable surface moves in the same direction as a flow of the stream.

10 Claims, 2 Drawing Sheets

DEVICE FOR COMPRESSIVE MOLDING STREAM OF FILLER FOR TOBACCO ROD

BACKGROUND OF THE INVENTION

1. Field of the Invention

The present invention relates to a device for compressive molding a stream of filler for a tobacco rod to a predetermined cross-sectional shape before the tobacco rod is continuously formed in a cigarette manufacturing machine.

2. Description of the Related Art

The cigarette manufacturing machine comprises a compression molding device for compressing a stream of filler including cut tobacco, and molding it to a predetermined cross-sectional shape, i.e., a cross-sectional circle. Such a stream compression molding stabilizes the forming of tobacco rod, i.e., filler wrapping with paper.

The compression molding device comprises a molding bed for guiding a filler stream with paper, and a compression mold arranged at the upper side of the bed, the so-called tongue, the tongue defining a compression molding passage for the stream between the bed and the tongue.

Since the tongue is fixed, the stream receives large resistance from the tongue when the filler stream passes through the compression molding passage. When flowing resistance of the stream of filler is large, the cut tobacco is liable to be overheated, and the crush of the cut tobacco is increased. Overheating of the cut tobacco results in a loss of the tase of any cigarettes obtained from the tobacco rod. The crush of the cut tobacco not only causes unstable tobacco rod forming itself, that is, filler wrapping with paper, but also generates soft spots having a low filler density in connection with filler in the tobacco rod. The presence of soft spots is liable to cause the dropout of filler or cut tobacco form the cut end of cigarette rod or cigarette obtained by cutting the tobacco rod.

SUMMARY OF THE INVENTION

An object of the present invention is to provide a compression molding device, which is capable of reducing the overheating of a stream of filler, and which is capable of preventing the generation of soft spots in a tobacco rod when the stream passes through a compression molding passage.

The above object can be attained by the compression molding device of the present invention. The compression molding device comprises a forming mold arranged downstream of a suction band in relation to a feeding direction of a filler stream, and the forming mold has a forming surface defining the compression mold passage for the stream. The compression molding device further comprises reducing means for reducing flowing resistance applied to the stream from the forming surface. The reducing means has a movable surface as a part of the forming surface, the movable surface running in a conveying direction of the paper for the stream.

According to the above-explained device, when the stream passes through the passage together with the paper, the stream is molded to be a predetermined cross-sectional shape, which is determined by the forming surface of the forming mold, while being compressed by the forming mold. In this case, since a part of the forming surface of forming mold, specifically, the movable surface, runs in the paper running direction with the stream, the flowing resistance applied to the stream from the forming surface is largely reduced. Therefore, when the stream passes through the passage, the stream is prevented from being overheated, and the crush of filler, i.e., cut tobacco, is reduced. As a result, not only the taste and flavor of cut tobacco can be maintained but also the stream wrapping with paper, i.e., the forming of tobacco rod, can be stably carried out. Further, the reduction in the crush of cut tobacco prevents the generation of soft spots in the tobacco rod thereby effectively improving the quality of tobacco rod.

More specifically, the movable surface of the forming mold may be realized from a part of an endless belt. In this case, part of the belt is exposed in the compression molding passage, and runs in the paper running direction.

Preferably, a belt guide for supporting part of the endless belt so as to guide the belt is arranged in the forming mold. The belt guide allows the part of the belt defining the movable surface to function as the forming surface effectively.

Part of the belt may extend between two pulleys. The pulleys can be arranged to be rotatable in the forming mold. Preferably, in this case, one pulley positioned at the upstream of the passage may be a pulley with a flange, and the other pulley positioned at the downstream of the passage may be a flat pulley. The flanged pulley is useful to restrict the meandering of the belt, and the flat pulley is useful to prevent the crush of cut tobacco.

Preferably, the other pulley may be a drive pulley. In this case, the other pulley can provide traction to the belt in accordance with its rotation, thereby ensuring the stable running of the part of belt as the movable surface.

The belt and the suction band are preferably connected to each other through a power transmission path. In this case, there is no need for a drive source for running the belt.

The forming mold can include a tongue having the forming surface and a shoe, which are integrally formed with the tongue, for guiding the stream from the suction band while the being peeled.

Further scope of applicability of the present invention will be become apparent from the detailed description given hereinafter. However, it should be understood that the detailed description and specific example, while indicating preferred embodiment of the invention, are given by way of illustration only, since various changes and modifications within the sprit and scope of the invention will become apparent to those skilled in the art from this detailed description.

BRIEF DESCRIPTION OF THE DRAWINGS

The present invention will become more fully understood from the detailed description given hereinbelow and the accompany drawings which are given by way of illustration only, and thus, are not limitative of the present invention, and wherein.

DETAILED DESCRIPTION OF THE PREFERRED EMBODIMENTS

Figure 1:
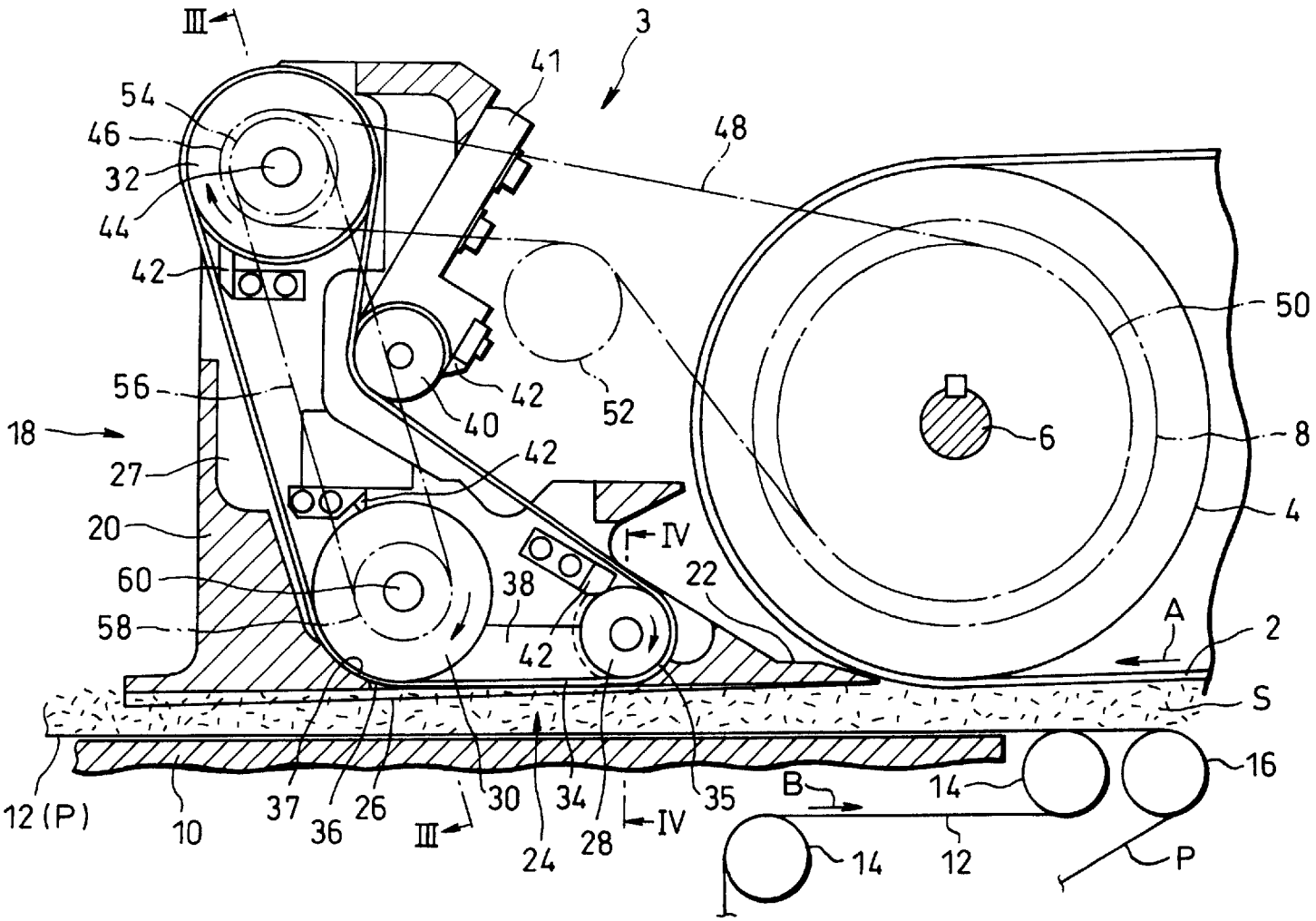
FIG. 1 is a vertical cross-sectional view of the compression molding device of the present invention.

FIG. 1 shows a part of a cigarette manufacturing machine, that is, an area ranging from an endless suction band 2 to a compression molding device 3. In FIG. 1, regarding the suction band 2, only the part thereof is shown. The band 2 extends between a pair of band rollers 4 (only one roller is shown in the figure) and turned around the rollers 4. Then, the band 2 runs in a direction of arrow A of FIG. 1 in accordance with the rotation of the band rollers 4. In accordance with the running of the band 2, the suction band 2 attracts cut tobacco, namely, filler on its lower surface or a suction surface from a chimney (not shown) in a layer form. The filler flows in the direction of arrow A in accordance with the running of band 2. In other words, the suction band 2 supplies a stream S of filler to the device 3.

The band roller 4 on the side of the device 3 is a drive roller. Due to this, a timing belt pulley 8 is attached to a roller shaft 6 of the drive roller 4 as shown by a dash-single-dot line. The pulley 8 is connected to a main shaft (not shown) of the cigarette manufacturing machine through a power transmission path. Therefore, the roller shaft 6, that is, the band roller 4 receives a rotational force from the main shaft of the machine, and rotates in one direction.

A molding bed 10 is horizontally arranged at the lower side of the suction band 2. More specifically, the molding bed 10 extends from the lower side of the band roller 4 to that of the compression molding device 3 in the direction of arrow A, and passes through a rod forming section (not shown) for a tobacco rod. The rod forming section includes an upper mold, which defines a forming passage of the tobacco rod in cooperation with the molding bed, a paste applying device, and a heater.

The molding bed 10 is surrounded with an endless garniture tape 12. The garniture tape 12 is guided by a plurality of guide rollers 14, and has a horizontal upper tape portion. The upper tape portion extends over the molding bed 10. A lower tape portion of the garniture tape 12 passes around a drive drum (not shown), and the drive drum has a drum shaft serving as the above-mentioned main shaft. When the drive drum is rotated, the garniture tape l2 runs in a direction of arrow B. Therefore, the feeding direction of stream S and the running direction of the upper tape portion of the garniture tape 12 are conformed to each other.

Paper P is guided to the molding bed 10 through a guide roller 16. Paper P is overlaid on the upper tape portion of the garniture tape 12, and runs with the garniture tape 12 in the direction of arrow A. In this case, the running speed of paper P conforms to the feeding speed of stream S. Paper P is delivered from a paper roll (not shown).

The compression molding device 3 comprises a forming mold 18. The forming mold 18 is arranged to be adjacent to the band roller 4 just above the molding bed 10. The forming mold 18 is fixed to a frame (not shown) of the cigarette manufacturing machine. The forming mold 18 has a tongue 20 and a shoe 22 arranged between the tongue 20 and the band roller 4. The shoe 22 and the tongue 20 may be different members from each other. However, as is obvious from FIG. 1, it is preferable that the shoe 22 be integrally formed with the tongue 20.

The shoe 22 is wedge-shaped, and the front edge thereof is connected to the suction surface of band 2 at the lower portion of band roller 4. The front edge of shoe 22 is in contact with the suction band 2 or close thereto. Therefore, the shoe 22 functions as a scraper for peeling the stream S of filler from the suction surface of the band 2.

The forming mold 18 has a lower surface opposite to the molding bed 10, that is, a forming surface 26. A compression molding passage 24 for the stream S is defined between the forming surface 26 and paper P on the bed 10. An inlet and an outlet of the passage 24 are defined by the distal edge of shoe 22 and the rear edge of tongue 20, respectively.

More specifically, in view of the cross section of the passage 24, the forming surface 26 has a linear shape at the front edge of shoe 22, and has substantially a semicircular shape at the rear edge of tongue 20, and then the forming surface 26 between the front edge of shoe 22 and the rear edge of tongue 20 has an arc shape. A radius of curvature of the arc is gradually reduced toward the rear edge of tongue 20 from the front edge of shoe 22. Moreover, as is obvious from FIG. 1, the forming surface 26 is inclined downwardly to the outlet side of the passage 24 with respect to a horizontal plane.

On the upper surface of molding bed 10, a molding groove (not shown) is formed. The molding groove guides the running of garniture tape 12, and curves paper P in U shape through the garniture tape 12. In other words, though the upper surface of molding bed 10 at the start end portion thereof is a flat surface, the molding groove grows from the start end portion of the molding bed 10. The width of molding groove gradually decreases toward the outlet of the passage 24. On the other hand, the depth of molding groove gradually increases toward the outlet of the passage 24, and the molding groove has a cross-sectional arc shape at the outlet thereof. As a result, a cross-sectional area of the passage 24 is gradually reduced toward the outlet from the inlet.

As is obvious from FIG. 1, the tongue 20 is of bootshape, and its lower surface is formed as the forming surface 26. In the tongue 20, a pulley chamber 27 is defined. In the lower portion of pulley chamber 27, a front pulley 28 and a rear pulley 30 are rotatably contained. The front and rear pulleys 28 and 30 are separated back and forth, in view of an axis of the passage 24. The front pulley 28 is a pulley with a flange whose diameter is smaller than the rear pulley 30, and the rear pulley 30 is a flat pulley.

In the upper portion of pulley chamber 27, an upper pulley 32 with a flange is rotatably contained. The upper pulley 32 is positioned at the upper portion of rear pulley 30.

Figure 2:
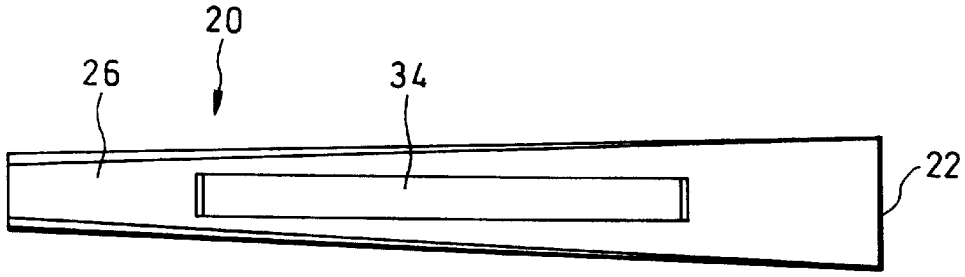
FIG. 2 is a bottom view of a tongue of FIG. 1.

An endless flat belt 34 is wound around the pulleys 28, 30, and 32. The molding belt 34 extends along the forming surface 26 of tongue 20 between the front and rear pulleys 28 and 30, thereby forming a part of the forming surface 26. In this case, the molding belt 34 provides a movable surface to the part of forming surface 26. More specifically, an opening 36 is formed on the part of forming surface 26. As is obvious from FIG. 2, the part of molding belt 34 is exposed into the passage 24 through the opening 36. The opening 36 is positioned at the center of the forming surface 26, and extends in a longitudinal direction of the forming surface 26, that is, the axis of the passage 24.

A belt guide 38 is fixed between the front and rear pulleys 28 and 30. The belt guide 38 supports the back of molding belt 34 slidably. More specifically, a lower surface of the belt guide 38 has a shape corresponding to the portion the forming surface 26 lost by the formation of opening 36. Therefore, when the molding belt 34 is pressed to the belt guide 38 from the interior of compression molding passage 24, the molding belt 34 can be deformed to be cross-sectional arc along the lower surface of the belt guide 38, thereby compensating for the lost portion of forming surface 26.

Both ends of the belt guide 38, that is, the front end face and the rear end face form an arc shape such that the front and rear end faces conform to the outer periphery of the front pulley 28 and that of the rear pulley 30, respectively. Then, there is little gap between the belt guide 38 and each of the pulleys 28 and 30. Moreover, as is obvious from FIG. 1, the pulley chamber 27 has arc seal walls 35 and 37 that are arranged at both end sides of the belt guide 38, respectively. The front pulley 28 is sandwiched between one seal wall 35 and the front end face of belt guide 38. The rear pulley 30 is sandwiched between the rear end face of belt guide 38 and the other seal wall 37. Paths guiding the running of molding belt 34 are defined between the seal wall 35 and the front pulley 28 and between the seal wall 37 and the rear pulley 30. There are little gaps between the molding belt 34 and each of the seal walls 35 and 37.

A tension pulley 40 is rotatably arranged between the front pulley 28 and the upper pulley 32. The tension pulley 40 is attached to the tongue 20 through a bracket 41. The tension pulley 40 provides a predetermined tension to the molding belt 34.

The pulleys 28, 30, 32, and 40 have scrapers 42, respectively. The edge of each of the scrapers 42 comes in contact with the outer peripheral surface of corresponding pulley.

The upper pulley 32 has a pulley shaft 44, and a toothed pulley, that is, a timing belt pulley 46 is attached to one end of the pulley shaft 44. A timing belt pulley 50 is also attached to the roller shaft 6 of band roller 4. An endless timing belt 48 extends between the pulleys 46 and 50, and turns around the pulleys 46 and 50. A predetermined tension is provided to the timing belt 48 from a tension roller 52. The tension roller 52 is rotatably arranged between the roller band 4 and the tongue 20.

Figure 3:
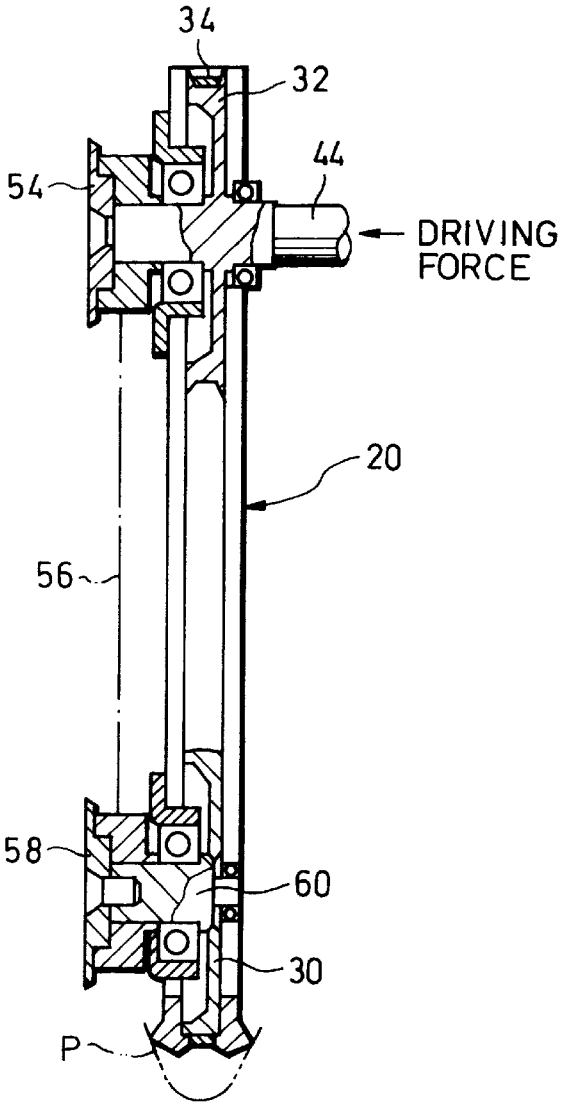
FIG. 3 is a cross-sectional view taken along line III—III of FIG. 1.

As shown in FIG. 3, a timing belt pulley 54 is further attached to the other end of pulley shaft 44 of the upper pulley 32. A timing belt pulley 58 is also attached to a pulley shaft 60 of the rear pulley 30. A timing belt 56 extends between the pulleys 54 and 58, and turns around the pulleys 54 and 58.

Figure 4:
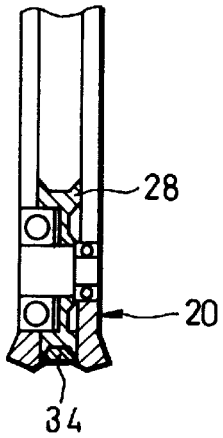
FIG. 4 is a cross-sectional view taken along line IV—IV of FIG. 1.

As is obvious from FIG. 3, the pulley shafts 44 and 60 are rotatably supported by the tongue 20 through a pair of bearings. Moreover, as is obvious from FIG. 4, a pulley shaft 62 of the front pulley 28 is also rotatably supported by the tongue 20 through a pair of bearings.

A drive force of the band roller 4 is transmitted to the upper pulley 32 through the pulley 50, the timing belt 48, and the pulley 46 in accordance with the running of the suction band 2. Then, the upper pulley 32 is rotated in a direction of an arrow in FIG. 1, that is, clockwise direction. The rotation of upper pulley 32 runs the molding belt 34 in one direction, thereby moving the movable surface of forming surface 26 in the direction where the stream S of filler is fed. In this case, the running speed of molding belt 34 preferably coincides with the feeding speed of the stream S, that is, the running speed of paper P.

A rotational force of the upper pulley 32 is transmitted to the rear pulley 30 through the pulley 54, the belt 56, and the pulley 58, and the molding belt 34 receives the traction from the rear pulley 30 and runs.

When the stream S of filler is fed to the forming mold 18 from the suction band 2 while the running of molding belt 34, the stream S is peeled from the band 2 at the shoe 22, i.e., the frond edge thereof so as to be guided to the compression molding passage 24. As a result, the stream S is supplied onto paper P from the suction band 2, and then passed through the passage 24 together with the running of paper P.

In the process in which the stream S passes through the compression molding passage 24, the stream S is compressed from the upper side by the forming surface 26 of tongue 20. The upper half of the stream S is gradually pressed and formed to be substantially semicircular, in view of the cross section thereof. On the other hand, paper P is gradually curved by the molding groove of molding bed 10 through the garniture tape 12 and formed to be cross-sectional U-shaped. As a result, the lower half of the stream S is wrapped with U-shaped paper P (see FIG. 3).

In this case, since the forming surface 26 has the movable surface, which is formed on its part by the molding belt 34, no speed difference is generated between the movable surface and the stream S. This results in large reduction of resistance received from the forming surface 26. Therefore, not only the stream S, that is, cut tobacco, can be prevented from being overheated, but also the crush of cut tobacco is greatly reduced.

Thereafter, the stream S, which has passed through the forming mold 18, that is, the compression molding passage 24 together with paper P, is wrapped with paper P as in a conventional manner way, so that a tobacco rod is continuously formed. Thus, since the cut tobacco is prevented from being overheated, the taste and flavor of tobacco are not lost.

The crush of cut tobacco in the stream S can be largely reduced, so that the wrapping stream S with paper P, that is, the forming of tobacco rod can be stably carried out. Also, the generation of soft spots in which the filling density of cut tobacco is extremely decreased in the tobacco rod can be reduced. As a result, at the time of cutting the tobacco rod or at the time of cutting the cigarette rod obtained by cutting the tobacco rod, it is possible to surely prevent the dropout of cut tobacco from the cutting end faces.

In the case of the compression molding device 3, since the molding belt 34 is run by receiving the traction from the rear pulley 30 in addition to the traction from the upper pulley 32, the running of molding belt 34 can be stabilized.

The gap between the front pulley 28 and the seal wall 35 and the gap between the rear pulley 30 and the seal wall 37 are substantially closed. This results in the reduction of cut tobacco entering the pulley chamber 27 through these gaps.

Since the pulleys 28, 30, 32, and 40 have the scrapers 42, respectively, cut tobacco adhered on the outer peripheries of these pulleys can be removed by these scrapers 42. Therefore, the stable running of molding belt 34 can be ensured without having cut tobacco entered between the outer peripheries of the pulleys and the molding belt 34.

The front pulley 28 has the pair of flanges on its outer periphery, and these flanges prevent the meandering of molding belt 34. In this case, the flanges of the front pulley 28 slightly project into the compression molding passage 24. However, there is no case in which the projection crushes cut tobacco of the stream S. More specifically, since the front pulley 28 is arranged at the upper stream side of the passage 24, the compression rate of stream S is still low when the stream S passes the front pulley 2. As a result, the flange projection does not cause the crush of cut tobacco.

As mentioned above, the rear pulley 30 has the flat periphery, and has no pair of flanges projecting into the compression molding passage 24. Therefore, the rear pulley 30 does not increase the crush of cut tobacco when the stream S passes the rear pulley 30.

The present invention is not limited to the above-mentioned embodiment, and various modifications can be made. For example, the compression molding device 3 can comprise an exclusive drive source for running the molding belt 34, that is, an electric motor. Moreover, the movable surface of forming surface 26 may extend over the entire area of the lower surface of the tongue 20, in view of the axial direction of the compression molding passage 24.

What is claimed is:

1. A device for compressive molding a stream of filler for a tobacco rod in which said stream is formed on a suction band of a cigarette manufacturing machine and supplied on paper running in one direction from the suction band side, said device comprising:

a forming mold arranged downstream of the suction band with respect to a feeding direction of said stream, said forming mold having a forming surface which is located opposite to a running surface for the paper and defining a compression molding passage for said stream between the paper and the forming surface, said stream being compressive molded into a predetermined shape when passing through the compression molding passage with the paper, and reducing means for reducing flowing resistance applied to said stream from the forming surface, said reducing means including a movable surface defined as a part of the forming surface and run in the paper running direction.

2. The device according to claim 1, wherein said reducing means further includes an endless belt built in said forming mold, a part of said belt being exposed into the compression molding passage as said movable surface.

3. The device according to claim 2, wherein said reducing means further includes a belt guide for supporting the part of said belt as said movable surface in said forming mold so as to guide the running of said belt.

4. The device according to claim 2, wherein the part of said belt extends between two pulleys built in said forming mold, wherein said two pulleys include a one pulley and an other pulley.

5. The device according to claim 4, wherein said two pulleys are separated from each other in an axial direction of the compression molding passage, one pulley located at an upstream side is a pulley with a flange, in view of the paper running direction.

6. The device according to claim 4, wherein said two pulleys are separated from each other in an axial direction of the compression molding passage, one pulley located at a downstream side is a flat pulley, in view of the paper running direction.

7. The device according to claim 4, wherein said two pulleys are separated from each other in an axial direction of the compression molding passage, wherein the one pulley of said two pulleys located at an upstream side is a pulley with a flange and the other pulley of said two pulleys is a flat pulley, in view of the paper running direction.

8. The device according to claim 7, wherein said other pulley is a drive pulley.

9. The device according to claim 2, wherein said reducing means further includes a power transmission path for transmitting a drive force to said belt from the suction band.

10. The device according to claim 2, wherein said forming mold includes a tongue having the forming surface, and a shoe being integrally formed with the tongue, for peeling said stream from the suction band and guiding said stream toward the tongue.

* * * * *